US009637268B2

(12) United States Patent
Franco Soutello et al.

(10) Patent No.: US 9,637,268 B2
(45) Date of Patent: May 2, 2017

(54) PERFUME DISPENSER AND APPLICATOR PACKAGE AND METHOD FOR USING THE PACKAGE

(71) Applicant: Natura Cosméticos S.A., Itapecerica da Serra (BR)

(72) Inventors: Ana Carolina Franco Soutello, Vila Ipojuca (BR); Anderson da Silva Santos, São Paulo (BR); Luna Menina Gonçalves Weyel, São Paulo (BR); Juliana Carvalhães Lago, Campinas (BR); Joice Panzarin Savietto, São Paulo (BR); Julio Cesar Legramanti Neves, São Paulo (BR); Rodrigo do Vale Ciossani, São Paulo-SP (BR); Flavio Di Sarno, São Paulo-SP (BR)

(73) Assignee: NATURA COSMETICOS S.A., São Paulo SP (BR)

( * ) Notice: Subject to any disclaimer, the term of this patent is extended or adjusted under 35 U.S.C. 154(b) by 0 days.

(21) Appl. No.: 14/243,381

(22) Filed: Apr. 2, 2014

(65) Prior Publication Data

US 2014/0299147 A1 Oct. 9, 2014

(30) Foreign Application Priority Data

Apr. 2, 2013 (BR) ..... 102013007953

(51) Int. Cl.

| | |
|---|---|
| ***A45D 40/26*** | (2006.01) |
| ***B65D 17/00*** | (2006.01) |
| ***A45D 34/04*** | (2006.01) |
| ***A45D 37/00*** | (2006.01) |

(52) U.S. Cl.

CPC ..... *B65D 17/163* (2013.01); *A45D 34/04* (2013.01); *A45D 37/00* (2013.01); *A45D 2200/1018* (2013.01); *A45D 2200/1045* (2013.01)

(58) Field of Classification Search

CPC ..... A45D 34/00; A45D 37/00; A45D 2200/1009; A45D 2200/1018; A45D 2200/1036; A45D 2200/1045; A61K 8/0208; A61M 35/006

See application file for complete search history.

(56) References Cited

U.S. PATENT DOCUMENTS

| | | | | | |
|---|---|---|---|---|---|
| 3,082,468 | A * | 3/1963 | Wattles | A45D 37/00 | 15/104.94 |
| 3,614,245 | A * | 10/1971 | Schwartzman | 401/132 | |
| 5,681,574 | A * | 10/1997 | Haber et al. | 424/402 | |
| 6,039,488 | A * | 3/2000 | Krawczyk et al. | 401/132 | |
| 2004/0234711 | A1 * | 11/2004 | Young | 428/34.1 | |
| 2012/0058179 | A1 * | 3/2012 | Altamar | A61J 3/07 | 424/451 |

* cited by examiner

*Primary Examiner* — Rachel Steitz
(74) *Attorney, Agent, or Firm* — B. Aaron Schulman, Esq.; Stites & Harbison, PLLC

(57) ABSTRACT

The present invention relates to a perfume dispenser and applicator package having in its interior one or more perfume capsules, wherein the one or more perfume capsules are wrapped in a compressed applicator material in the interior of the package, the one or more perfume capsules being ruptured by pressure exerted on the package, the one or more perfume capsules further moistening the compressed applicator material after rupture, and wherein the pressure on the package allows the expansion of the moistened applicator material outwardly through an opening in the package.

12 Claims, 1 Drawing Sheet

PERFUME DISPENSER AND APPLICATOR PACKAGE AND METHOD FOR USING THE PACKAGE

Figure 1A:
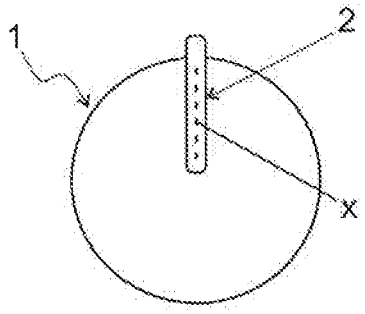

The present invention relates to a perfume dispenser package which also has the function of a perfume applicator. More specifically, the invention relates to a package that dispenses a single dose of perfume.

BACKGROUND OF THE INVENTION

In the context of the description below, any reference to "perfume capsule" also encompasses the plural form, that is, "capsules".

As used hereinafter, the term "user" is generic, referring to both female and male users.

Perfumes are usually commercialized in glass bottles containing a volume that allows multiple uses. These bottles are usually kept in a closet or dressing table, since they are not intended to be carried by the user, for example in a handbag. Smaller bottles can be used in such a manner, as in the case of some packages in the form of tube bottles, but they do not always have a suitable type of closure and can leak inside the bag of the user.

In view of such problems, the inventors have developed based on the concept of biomimetic a small sized perfume dispenser package, containing a small amount of perfume, particularly a single dose, or monodose, which allows topical application of the same.

Biomimicry, as known to those skilled in the art, is the science which draws on nature to produce products that mimic their actions. In this sense, the weak points and the bursting of the same at the fluid dispensing container of the present invention mimic the natural seed dispersal strategy (explosive dehiscence), which occurs when the fruits are dry and structures that involve rupture when applying light pressure on certain points, releasing the seeds.

Biomimicry, as known to those skilled in the art, is the science which draws on nature to produce products that mimic their action. In this sense, said package contains one or more capsules of perfume, wrapped in cotton or similar material, that mimic the flower bud impregnated with liquid. When the package is compressed, the internal perfume capsule brakes, just like a seed with perfume of a flower breaking, moistening the cotton. Subsequently, part of the outer shell of the package opens, causing the compressed cotton moistened with perfume to expand out of the open portion of the package, which becomes a perfume applicator.

Alternatively, the package of the invention may be used as follows: first the package is opened, giving the cotton or similar material space to expand, and then the package is pressed to cause a rupture in the perfume inner capsule which will moisten the already expanded cotton.

In the function of perfume applicator, the package of the invention, already opened, allows the user to hold it in her/his hand and spread the perfume soaked in the cotton by contact with and rubbing on the body of the user or other person (hands, arms, neck, hair, etc.).

The inner perfume capsule of the package of the invention is made of material that is impermeable to perfume ingredients, for example water, alcohol, essences, etc. Suitable materials, not excluding other alternatives, are gelatin, silicone, plastic, rubber, combinations of these materials with each other or with other materials. The surface of said capsule is preferably provided with a region of weakness (for example, one or more points, one or more lines, etc.), so that it can be ruptured without requiring much effort from the user.

The material involving the perfume capsule inside the package of the invention, herein referred to as applicator, is typically a wad of hydrophilic cotton, but it can be any other material known to skilled person which may serves as a perfume applicator, for example, a blend of hydrophobic or hydrophilic yarns and fibers, natural or artificial (e.g. cellulose acetate, polypropylene, etc.), said blend being a random tangle of fibers (e.g. a wad) or a more structured form, such as woven or non-woven tissue. A flexible foam of any nature, natural or artificial, can also be used. A combination of these alternatives can also be used.

One characteristic of the applicator material is that it is initially compacted or compressed, so that it expands when the package is opened, and then it can be rubbed on the skin or hair to transfer the perfume in which it is soaked or moistened after the inner perfume capsule is broken. A suitable volume expansion of the applicator material after breaking the packing, not excluding other alternatives, is in the order of 50%, 100% or more.

The word "perfume", as in the broader context of the invention is generic, encompassing alternatives such as essence, cologne, milk, cream and any agents or formulations for topical application, particularly those to perfume or odorize, even if they contain other ingredients with other purposes such as moisturizers, colorants, antiperspirants, etc.

The amount of perfume contained in the inner capsule of the package of the invention can be any amount, provided it is considered sufficient to fulfill the intended result, particularly, to odorize after contact with skin or hair. A suitable volume of a perfume formulation contained in said capsule, not excluding other alternatives, is between 1 and 20, particularly between 1 and 10 ml.

The outer package of the invention can be made of any material, provided that it is suitable for its use. In this sense, it should have sufficient flexibility so that, when pressure is applied to it, the inner perfume capsule is compressed, which causes it to rupture. Suitable materials, not excluding other alternatives, are polymeric films, such as plastic, silicone or rubber, compounds of these two materials or other materials. The material is also such that it can be opened by the user, either by pressure causing a rupture and opening the shell, particularly a pre-weakened region (or frangible region), of by opening by removing a substrate that obstructs a preexisting opening in the shell, for example, a removable tape of non-permanent adhesion.

The perfume applicator dispenser package of the invention can be of any format, provided that it is suitable for, its use. A suitable format, not excluding other alternatives, is the format of a circular waffle, as shown in the examples below.

The images associated with the examples illustrate the invention without limiting the scope of protection to such an embodiment.

FIG. 1A shows an external front view of the package 1 of the invention, comprising the opening tape 2 affixed to a line X preexisting in the package shell 1, keeping it closed.

Figure 1B:
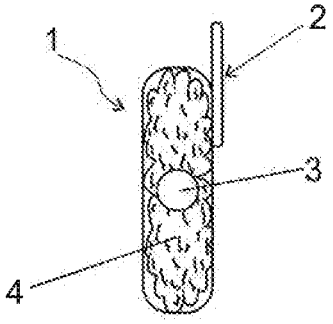

FIG. 1B shows a cross-section side view of the package 1, showing its contents, namely, a perfume capsule 3 surrounded by compressed cotton 4.

Figure 2A:
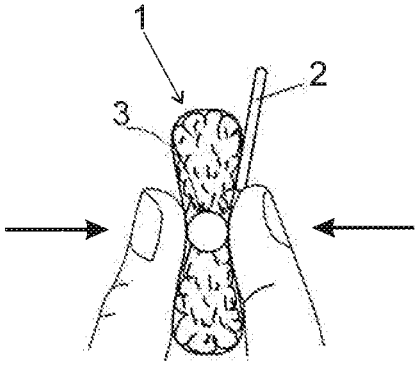

FIG. 2A shows the fingers of a user pressing the package 1 to cause rupture of the perfume capsule 3, for the perfume to moisten the cotton 4.

Figure 2B:
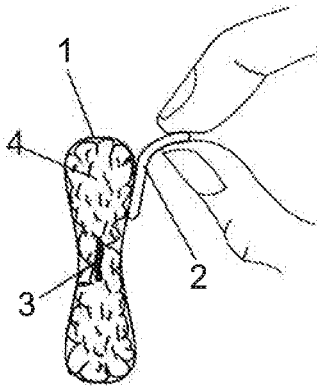

FIG. 2B shows the moment when, after the rupture of the perfume capsule 3, the user removes the tape 2 to open the package.

Figure 3A:
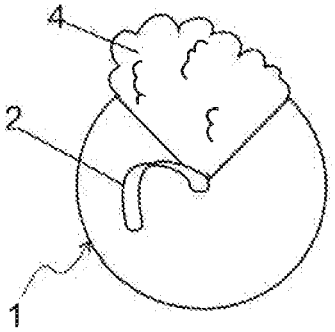
Figure 3B:
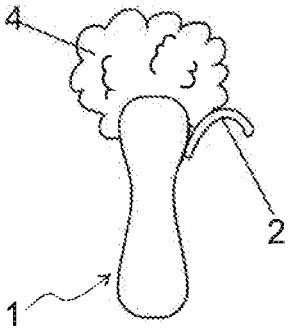

FIGS. 3A and 3B show the arrangement of the package 1 after it is opened (the tape is removed 2), wherein the cotton 4 soaked in perfume expands outward after line X is opened by removing tape 2. The user can then transfer the perfume from the package to the skin or hair, by rubbing the cotton 4 moistened with perfume on the skin.

The information and figures contained herein enable one skilled in the art to carry out the invention in manners that are not specifically described, but are equivalent forms that have the same function to achieve the same result, in which case they are covered by the appended claims.

The invention claimed is:

1. Perfume dispenser and applicator package comprising in its interior one or more perfume capsules, the one or more perfume capsules being made of gelatinous material, wherein the one or more perfume capsules are wrapped in a compressed applicator material in the interior of the package, wherein the one or more perfume capsules are ruptured by pressure exerted on said package, so as to further moisten the compressed applicator material after said rupture, and wherein the pressure applied on the package to rupture the capsules subsequently allows the breaking of a region of weakness in the package, forming an opening, and the expansion of the moistened applicator material outwardly through the opening in the package.

2. Perfume dispenser and applicator package according to claim 1, wherein said applicator material is a blend of hydrophobic or hydrophilic yarns and fibers, natural or artificial, said blend being a random tangle of fibers or a more structured form, the random tangle of fibers being a wad and the more structured form being a woven or non-woven tissue.

3. Perfume dispenser and applicator package according to claim 1, wherein said applicator material is flexible foam.

4. Perfume dispenser and applicator package according to claim 1, wherein said applicator material is a cotton wad.

5. Perfume dispenser and applicator package according to claim 1, wherein said applicator material, after opening said package, expands by 50%, 100% or more in relation to its initial compressed volume.

6. Perfume dispenser and applicator package according to claim 1, wherein said perfume capsule is made of a material that is impermeable to perfume ingredients, said the material comprising water, alcohol or essences.

7. Perfume dispenser and applicator package according to claim 1, wherein said perfume capsule has a region of weakness that breaks under pressure.

8. Perfume dispenser and applicator package according to claim 1, wherein said perfume capsule contains between 1 and 20 ml of perfume.

9. Perfume dispenser and applicator package according to claim 1, wherein the package is made of a flexible material, the flexible material comprising a plastic polymeric film, silicone, rubber or combinations of these materials with each other.

10. A method of using a package as defined in claim 1, comprising initially applying pressure to the package in order to break one or more perfume capsules in its interior, and then opening the package to expand the compressed applicator material.

11. Method of using the package as defined in claim 10, wherein the package is opened by applying pressure externally to break a region of weakness in the shell of said package.

12. A method of using a package as defined in claim 1, comprising initially opening the package to expand the compressed applicator material, and then applying pressure to the package to break one or more perfume capsules in its interior.

* * * * *